US005261383A

United States Patent [19]

Halamay

[11] Patent Number: 5,261,383

[45] Date of Patent: Nov. 16, 1993

[54] COMBINED ARCHERY ARROW RETAINER, GUIDE AND OVERDRAW COMPENSATING DEVICE

[76] Inventor: Wolodymyr D. Halamay, Box 356, Rt. 209, Westbrookville, N.Y. 12785

[21] Appl. No.: 963,987

[22] Filed: Oct. 21, 1992

[51] Int. Cl.[5] ..... F41B 5/22

[52] U.S. Cl. ..... 124/44.5; 124/24.1; 124/86

[58] Field of Search ..... 124/23.1, 24.1, 25.5, 124/25.6, 25.7, 44.5, 86, 88

[56] References Cited

U.S. PATENT DOCUMENTS 4,351,311 9/1982 Phares ..... 124/44.5
4,865,007 9/1989 Saunders ..... 124/44.5
5,025,773 6/1991 Hintze et al. ..... 124/44.5
5,031,601 7/1991 Gunter ..... 124/44.5
5,042,450 8/1991 Jacobson ..... 124/44.5

*Primary Examiner*—Randolph A. Reese
*Assistant Examiner*—John Ricci
*Attorney, Agent, or Firm*—Anthony F. Cuoco

[57] ABSTRACT

A bracket is mounted to an archery bow so as to be adjustable relative to the bow string to compensate for arrow overdraw. A body member is adjustably mounted to the bracket to provide accurate arrow flight and to avoid interference of arrows of various diameters with the bow. The body supports three rollers. The rollers cooperate to support a nocked arrow in a readied position and to guide the arrow upon release. The roller arrangement enables arrows of various diameters to be retained and guided and provides for easy insertion and retention of the arrow in the device.

9 Claims, 2 Drawing Sheets

COMBINED ARCHERY ARROW RETAINER, GUIDE AND OVERDRAW COMPENSATING DEVICE

BACKGROUND OF THE INVENTION

This invention relates generally to devices used in conjunction with archery bows and arrows and, particularly, to a device which functions to retain an arrow in a readied position on a bow, to guide the arrow upon release from the bow and to compensate for arrow overdraw.

Bow arrow retaining devices for maintaining an arrow in a readied position when the arrow is nocked and the bow string is pulled to a moderate tension are known in the art. Typically, these devices feature an arrow engaging member which disengages the arrow when the arrow is pulled back before release. Arrow guiding devices and overdraw compensating devices are likewise known in the art.

For example, U.S. Pat. No. 4,372,282 which issued to Edward Sanders on Feb. 8, 1983 (U.S. Class 124/24 R) discloses an arrow support or retaining device. The Sanders patent teaches a device which is mounted to the front of the handle section of an archery bow for supporting an arrow in its ready-to-draw position, but does not teach guiding the arrow during release, nor does the patent address overdraw.

U.S. Pat. No. 4,282,850 which issued to Allen E. Warnicke on Aug. 11, 1981 (U.S. Class 124/24 R) teaches a device included in the handle section of an archery bow which merely supports a nocked arrow in a ready position, i.e. functions as an arrow rest, and guides the arrow during release.

U.S. Pat. No. 5,025,773 which issued to Kurt Hintze on Jun. 25, 1991 (U.S. Class 124/445; 124/24.1) relates to an arrow rest for use with an archery bow. The arrow rest includes a mounting member attached at one end to the bow handle and extending between the handle and the bowstring. A yoke is adjustably mounted between the handle and the bowstring and defines an opening. A pair of pedestals are mounted to the yoke and extend into the opening to support an arrow. A resilient member is mounted to the yoke and extends into the opening in opposing relationship to the pedestals. The resilient member is adjustably positioned so that the arrow is loosely constrained by the resilient member and the pedestals.

Further, Browning Archery Division, Morgan, Utah, among others, markets arrow retaining, guiding and overdraw compensating devices.

However, the prior art noted above does not teach the arrangement of the present invention which combines the retaining, guiding and overdraw compensating features into a single device and has other features not addressed by the prior art that will be recognized as desireable.

SUMMARY OF THE INVENTION

This invention contemplates a combined archery arrow retainer, guide and overdraw compensating device wherein a bracket is mounted to a side of the handle of an archery bow and extends adjustably rearwardly therefrom toward the bow string. A body member is mounted to the bracket and extends adjustably transversely therefrom. A yoke member is adjustably disposed along the longitudinal axis of the body member and is supported within said body member. Two axles are equiangularly disposed relative to the longitudinal axis and converge toward said axis, and are supported within the body member. The adjustably disposed yoke member and each of the axles support respective rollers, with said rollers cooperating to provide a space within which a nocked arrow is retained by the rollers in a readied position, and which rollers guide the arrow upon release from the bow. The arrangement enables the device to be used with arrows of various diameters, and to enable the arrow to be easily inserted and securely retained by the device. The adjustability of the bracket on the bow accommodates different arrow lengths and bow string draw distances to compensate for arrow overdraw, and the adjustability of the body member on the bracket insures accurate flight of the arrow and clearance between the arrow and the bow irrespective of the arrow diameter.

DETAILED DESCRIPTION OF THE INVENTION

Figure 1:
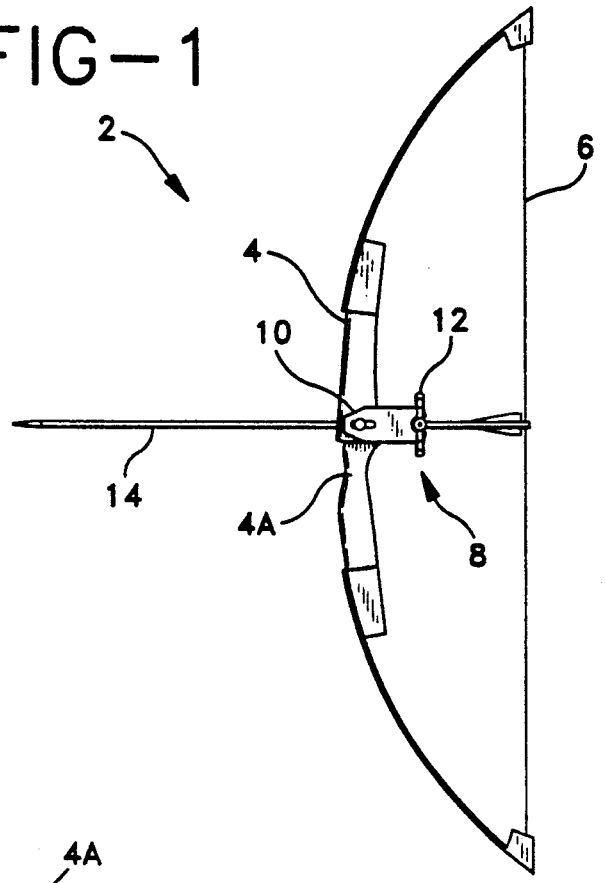
FIG. 1 is a diagrammatic representation showing an archery bow equipped with a device according to the invention and showing a nocked arrow in a readied position in said device.

With reference to FIG. 1, an archery bow is designated by the numeral 2. Archery bow 2 includes a handle 4 and a string 6. A device according to the invention is designated by the numeral 8. Device 8 includes a bracket 10 mounted to bow handle 4 as will be hereinafter described and a body member 12 mounted to bracket 10 as will also be hereinafter described. An arrow 14 is nocked in bow string 6 and is retained in a readied position by body member 12 as will likewise be hereinafter described, and is guided by the body member upon release from the bow.

Figure 2:
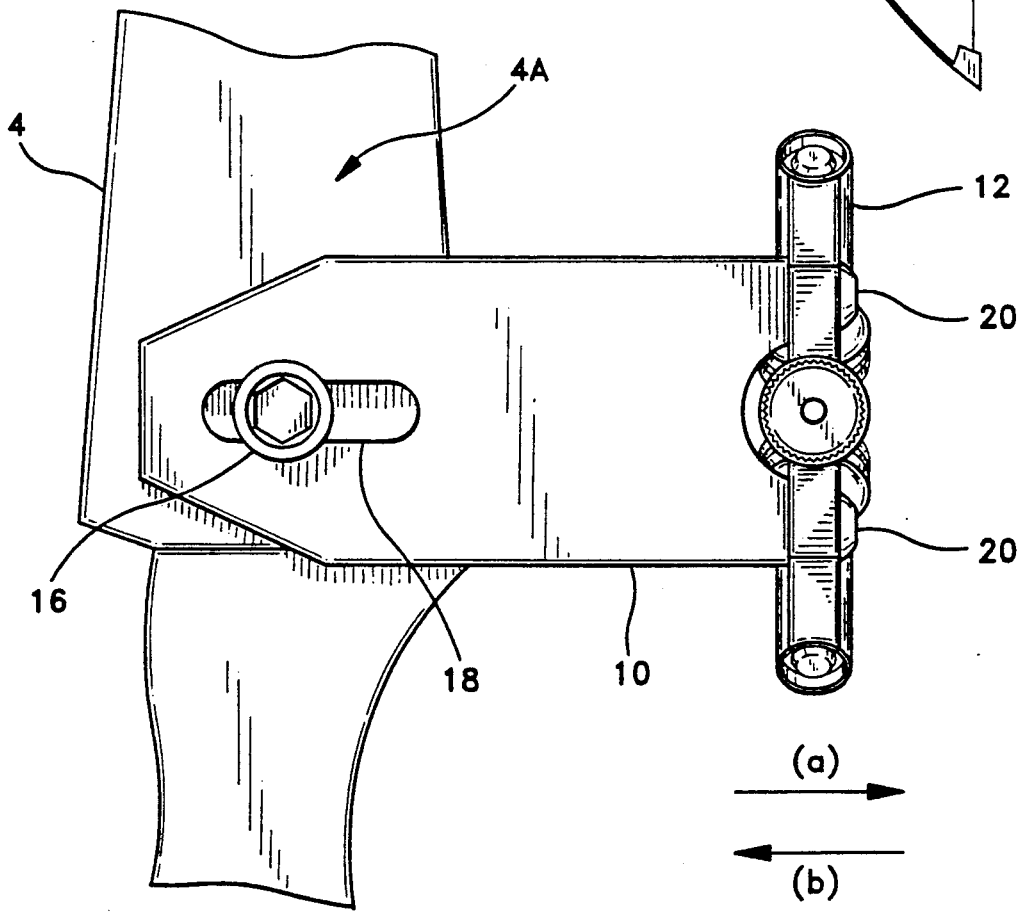
FIG. 2 is a diagrammatic representation particularly showing a bracket adjustably mounted to a side of the handle of the bow and showing a body member supported by the bracket.

With reference to FIG. 2, bracket 10 which may be of a suitable plastic material, is adjustably mounted to a side 4A of bow handle 4 by a bolt or screw 16 engaging an elongated slot 18 in bracket 10 and engaging a hole (not otherwise shown) in side 4A of bow handle 4. Alternatively, slot 18 may be replaced by a series of holes in suitable spaced relation to achieve the same result as will be readily appreciated.

With the arrangement described, bracket 10 is adjustably mounted to bow handle side 4A so as to be displaceable relative to bow string 6 (FIG. 1). As will be hereinafter more fully described, this arrangement compensates for arrow overdraw by an archer using bow 2 and arrow 14, as is likely to occur.

Body member 12 is adjustably mounted to bracket 10 by screws or the like 20 engaging slots 21 so as to be substantially normal thereto and to extend transversely therefrom. This particular mounting arrangement of body member 12 to bracket 10 provides clearance between the bow and arrows of various diameters for accurate flight of the arrows as will be more fully discerned with reference to FIG. 3.

Figure 3:
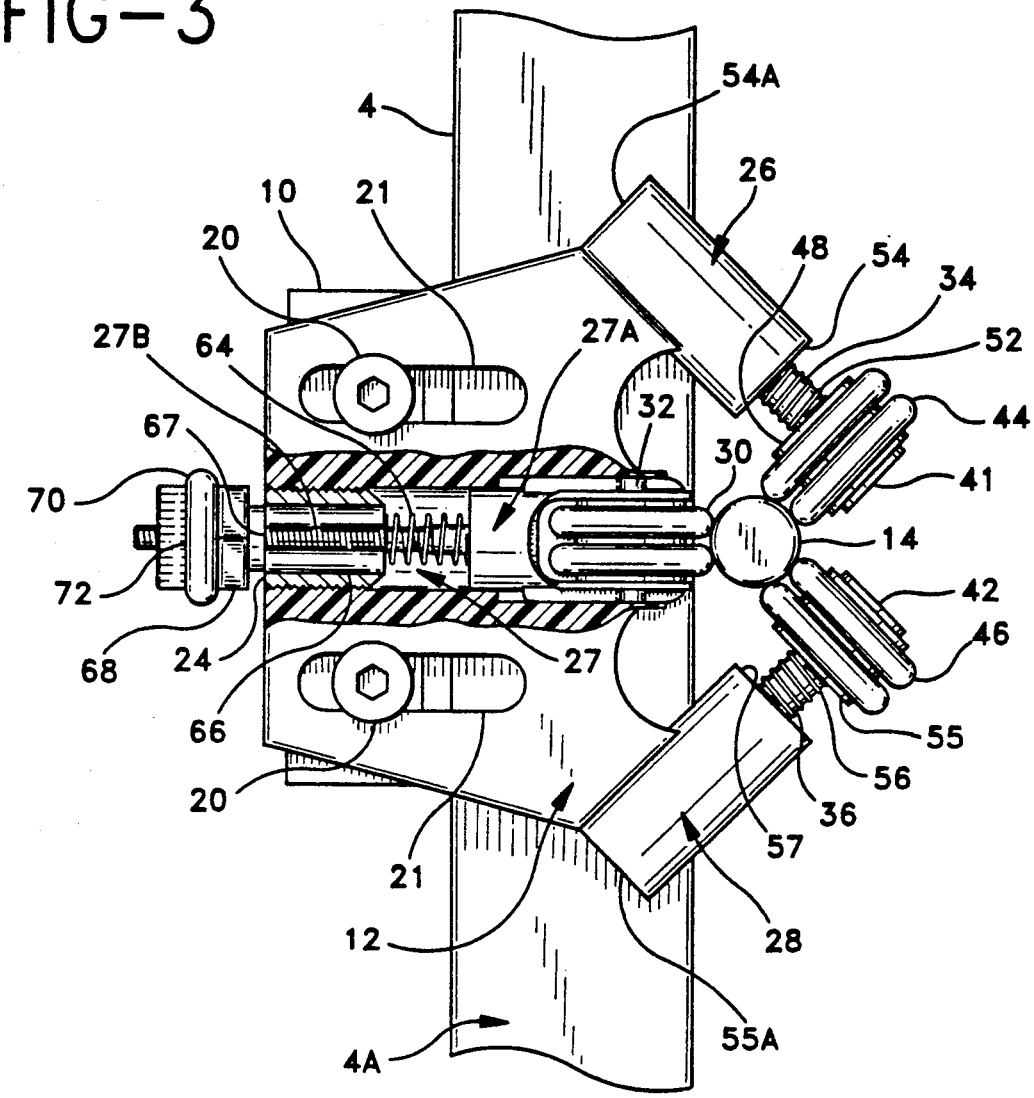
FIG. 3 is a partially sectioned diagrammatic representation particularly showing a portion of the bracket and showing the body member in substantial detail.

With particular reference now to FIG. 3, body member 12 which may be of a suitable plastic material has an axially disposed hollow, substantially cylindrical sleeve 24 extending axially therethrough. Body member 12 has a pair of hollow substantially cylindrical sleeves 26 and 28 which are equiangularly disposed relative to sleeve 24 on opposite sides of said sleeve and converge toward the longitudinal axis of the body member.

A yoke member 27 is disposed in sleeve 24 and includes a yoke 27A extending from one end of sleeve 24. Yoke member 27 includes a threaded stud 27B which is integral with yoke 27A and extends from the opposite end of the sleeve. Yoke 27A rotatably supports a roller 30 of a suitable material, such as Teflon or Delrin (registered trademarks of the Dupont Corp.), or other low friction materials, on a pin 32 extending through the yoke.

An axle 34 is disposed in sleeve 26 and an axle 36 is disposed in sleeve 28. Axles 34 and 36 are retained in their respective sleeves as by an O-ring 38 carried on one of the axle ends. O-ring 38 abuts a shoulder 40 internal the respective sleeves 26 and 28. This feature of the invention is best illustrated in FIG. 4, wherein sleeve 26 and axle 34 are shown for purposes of illustration.

Figure 4:
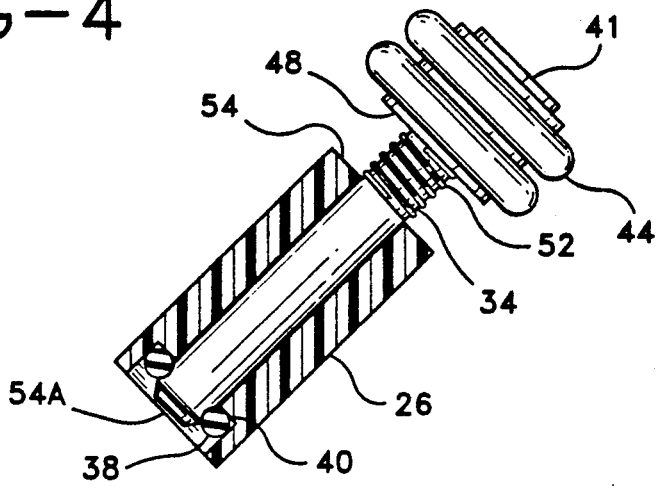
FIG. 4 is a diagrammatic representation showing the arrangement wherein rollers are supported on axles supported within the body member.

With continued reference to FIGS. 3 and 4, axles 34 and 36 terminate at their ends opposite the respective O-rings in flanges 41 and 42, respectively. Axle 34 rotatably supports a roller 44 at its flange end, and which roller may be of a material such as that of roller 30, and axle 36 rotatably supports a like roller 46 at its flange end.

With specific reference to FIG. 4, wherein the configuration of axle 34 and roller 44, will be considered for purposes of illustration, roller 44 is disposed on a washer 48. Roller 44 is thus sandwiched between flange 41 and washer 48 so as to be rotatably supported on axle 34 as aforenoted. It will be appreciated that axle 36 and roller 46 are arranged in a like configuration.

A compression spring 52 surrounds axle 34 so as to be captured between washer 48 and end 54 of sleeve 26. Likewise, a compression spring 56 surrounds shaft 36 and is captured between corresponding washer 55 and corresponding end 57 of sleeve 28. In this regard, particular reference is made to FIG. 3.

With the arrangement described including axles 34 and 36, rollers 44 and 46, and springs 52 and 56, it will be appreciated that rollers 44 and 46 are biased by the respective springs 52 and 56 against the respective flanges 41 and 42. The axles may be displaced into the respective sleeves 26 and 28 as by pushing on flanges 41 and 42, respectively. Normally, the respective axle O-rings, such as O-ring 38, remain within the respective sleeves. Upon pushing on flanges 41 and 42 so as to compress the respective springs 52 and 56, the O-rings are pushed out of ends 54A and 55A of sleeves 26 and 28. This feature is important when inserting an arrow in the device of the invention, as will be readily appreciated.

Yoke member 27 is biased within sleeve 24 so that the position of yoke 27A and roller 30 supported thereby is adjustable by the arrangement particularly shown in FIG. 3 and to be next described.

Thus, stud 27B is externally threaded at least partially along its length, and which threaded length extends external sleeve 24 at the end thereof opposite the yoke end of the sleeve. A spring 64 surrounds stud 27B. Sleeve 24 is internally threaded at said opposite end.

An externally threaded insert 66 is in threaded engagement with the internally threaded portion of sleeve 24 and spring 64 is captured between yoke 27 and insert 66. Insert 66 has a hole 67 extending therethrough and stud 27B extends through said hole and external said insert. Insert 66 has a head 68 on an end extending from sleeve 24. A resilient member 70 is disposed on stud 27B and an internally threaded knurled knob 72 is in threaded engagement with the externally extending stud so as to sandwich the resilient member between the head and knob.

It will thus be recognized that yoke 27A and roller 30 supported thereon are adjustably positioned via the noted threaded engagements of insert 66 and sleeve 24 in cooperative relation with spring 64. That is to say, insert 66 is threaded into and out of sleeve 24 via head 68 to adjust the position of yoke 27A and roller 30 by the compression or expansion of spring 64 as the case may be. Further expansion of spring 64 is prevented by threadingly tightening knob 72 against resilient member 70.

With the described arrangement, a space is formed between rollers 30, 44 and 46, and into which space nocked arrow 14 is disposed and retained therein in a readied position by contact with the rollers. When bow string 16 is drawn, rollers 30, 44 and 46 are effective for guiding the arrow away from the bow. Depression of rollers 44 and 46 against the spring bias effected by springs 52 and 56 enables easy insertion of arrow 6 into the space between the rollers. The adjustability of roller 30 effected as aforenoted accommodates arrows of various diameters. Arrow 14 can be removed from the bow only as by shooting the arrow or by compressing springs 52 and 56.

As aforenoted, body member 12 is adjustably mounted to bracket 10 via screws 20. This is accomplished by screws 20 engaging elongated slots 21 in base 12 and engaging holes (not otherwise shown) in bracket 10. Body member 12 may thus be transversely displaced relative to bracket 10. This feature of the invention is important in that it accommodates appropriate clearance for arrows 14 of various diameters so that the arrows fly accurately and avoid contact with bow 4 as might otherwise occur.

A significant feature of the invention is that it compensates for arrow overdraw. This is accomplished by adjusting bracket 10 via slot 18 and screw 16 (FIG. 2) relative to bow string 6 (FIG. 1) as aforenoted. The adjustment is commensurate with the length of arrow 14 and the distance through which bow string 6 is drawn, as may vary from archer to archer.

There has thus been described a combined archery arrow retainer, guide and overdraw compensating device wherein a bracket is adjustably mounted to an archery bow to extend rearwardly therefrom toward the bow string. A body member is adjustably mounted to the bracket to extend transversely therefrom. A yoke member is supported by the body member and extends along the body member axis. A pair of axles are equiangularly disposed relative to the yoke member and converge toward the body member axis. Each of the axles and the yoke member carries a roller with the rollers providing an adjustable space within which a nocked arrow is retained by the rollers in a readied position, and which rollers guide the arrow upon release from the bow. The arrangement described accommodates arrows of various diameters and enables an arrow to be easily inserted and securely retained by the device. The adjustable mounting feature of the bracket to the bow accommodates different arrow lengths and bow string draw distances to compensate for arrow overdraw, as is desireable for the safety of the archer. The adjustable mounting of the body to the bracket as described insures clearance between the arrow and the bow which varies for arrows of various diameters. with the above description of the invention in mind, reference is made to the claims appended hereto for a definition of the scope of the invention.

What is claimed is:

1. A combined archery arrow retainer, guide and overdraw compensating device, comprising:

a bracket mounted to a side of an archery bow handle so as to extend toward the bow string;

a body member mounted to the bracket so as to be substantially normal thereto and to extend transversely therefrom;

first, second and third rollers;

first means arranged with the body member for supporting the first roller, and including means for adjustably positioning said first roller;

second means arranged with the body member for supporting the second roller, and including means for biasing said second roller;

third means arranged with the body member for supporting the third roller, and including means for biasing said third roller;

said first, second and third rollers cooperating to provide an adjustable space therebetween; and a nocked arrow disposed within the adjustable space against the adjustable position of the first roller and the bias on the second and third rollers so as to be retained between the first, second and third rollers in a readied position, and to be guided by said rollers upon release from the bow.

2. A device as described by claim 1, wherein the first means includes:

an axially disposed hollow, substantially cylindrical sleeve extending axially through the body member;

a yoke member having a yoke extending through one end of the axially disposed sleeve and a stud integral with the yoke and having an externally threaded portion extending through the opposite end of said sleeve;

the first roller supported by the yoke; and the means for adjustably positioning said first roller including means arranged with the axially disposed sleeve and the externally threaded portion of the stud.

3. A device as described by claim 2, wherein the second means includes:

a first hollow, substantially cylindrical sleeve extending through the body member in angular relation to the axially disposed sleeve on one side thereof so as to converge toward the body member axis;

a first axle supported within the first sleeve and having a portion extending from the end thereof corresponding to the one end of the axially disposed sleeve;

the second roller supported on the extending end of the first axle; and first biasing means captured between the second roller and the first sleeve for biasing the second roller.

4. A device as described by claim 3, wherein the third means includes:

a second hollow, substantially cylindrical sleeve extending through the body member in angular relation to the axially disposed sleeve on an opposite side thereof, said angular relation corresponding to that of the first sleeve, so as to converge toward the body member axis;

a second axle supported within the second sleeve and having a portion extending from the end thereof corresponding to the one end of the axially disposed sleeve;

the third roller supported on the extending end of the second axle; and second biasing means captured between the third roller and the second sleeve for biasing the third roller.

5. A device as described by claim 4, wherein:

the second and third rollers are displaced against the bias provided by the first and second biasing means, respectively, to facilitate disposing the arrow in the space between the first, second and third rollers.

6. A device as described by claim 5, wherein:

the position of the first roller is adjusted to adjust the space between the first, second and third rollers in accordance with the diameter of the arrow.

7. A device as described by claim 1, wherein:

the bracket mounted to the side of the archery bow handle so as to extend toward the bow string is mounted so that the distance between the bracket and the bow string is adjustable to compensate for arrow overdraw.

8. A device as described by claim 1, wherein the body member mounted to the bracket so as to be substantially normal thereto and to extend transversely therefrom is transversely adjustable on the bracket to provide accurate flight of the arrow and clearance between the nocked arrow retained in the space between the rollers and the bow handle irrespective of the diameter of the arrow.

9. A device as described by claim 2, wherein the means arranged with the axially disposed sleeve and the externally threaded portion of the stud includes:

the opposite end of the sleeve having an internally threaded portion;

an insert having an externally threaded portion in threaded engagement with the internally threaded portion of the sleeve;

said insert having a through hole through which the threaded portion of the stud extends external the sleeve;

biasing means captured between the yoke and the insert for biasing said yoke;

said insert having a head external the sleeve;

a knob in threaded engagement with the threaded portion of the stud which extends external the sleeve;

resilient means sandwiched between the head and the knob;

said insert being threadingly adjusted in the sleeve via the head to compress or expand the biasing means for adjusting the position of the yoke and the first roller; and further expansion of the biasing means being prevented by threadingly tightening the knob against the resilient member.

* * * * *